United States Patent [19]

Ito et al.

[11] Patent Number: 4,769,042

[45] Date of Patent: Sep. 6, 1988

[54] PROCESS FOR HEAT TREATMENT OF COAL

[75] Inventors: Yoshifumi Ito; Kiyomichi Taoda, both of Hiroshima; Mamoru Tamai, Tokyo; Fumiaki Sato, Tokyo; Michio Teramoto, Tokyo, all of Japan

[73] Assignee: Mitsubishi Jukogyo Kabushiki Kaisha, Tokyo, Japan

[21] Appl. No.: 65,783

[22] Filed: Jun. 24, 1987

[30] Foreign Application Priority Data

Feb. 27, 1987 [JP] Japan ..... 62-44379

[51] Int. Cl.[4] ..... C10L 9/08

[52] U.S. Cl. ..... 44/626; 34/13

[58] Field of Search ..... 44/1 R, 1 G; 34/10, 34/13

[56] References Cited

U.S. PATENT DOCUMENTS 3,985,517 10/1976 Johnson ..... 44/1 R
4,192,650 3/1980 Seitzer ..... 44/1 G
4,401,436 8/1983 Bonnecaze ..... 44/1 G

*Primary Examiner*—Patrick P. Garvin

*Assistant Examiner*—George R. Fourson

*Attorney, Agent, or Firm*—Jules E. Goldberg

[57] ABSTRACT

There is provided a process for the heat treatment of coal which comprises heating and drying low grade coal such as subbituminous coal and brown coal containing less than 80% of carbon and more than 33% of volatile matter (dry mineral matter-free basis) and having a high moisture content and a particle diameter smaller than 2 inches, with a high-temperature gas containing less than 5% of oxygen in a fluidized bed for 2–10 minutes until the coal temperature reaches 180°–400° C., and subsequently cooling the coal by spraying water in a fluidized bed for 2–10 minutes until the coal temperature decreases to 60° C. or below at which time the coal holds the maximum moisture given by wetting. The heating process may be performed in two steps, in which case coal is heated with a high-temperature gas to 80°–150° C. in the first step so that the moisture of coal is reduced below the inherent moisture. The cooling process may be performed in two steps, in which case heated coal is rapidly cooled to about 120° C. with a cooling gas of high steam content in the first step.

4 Claims, 6 Drawing Sheets

PROCESS FOR HEAT TREATMENT OF COAL

FIELD OF THE INVENTION AND RELATED ART STATEMENT

The present invention relates to a process for heat treatment of coal which is designed to improve low-grade coal such as subbituminous coal of high moisture content by means of heating with a high-temperature gas.

Low grade coal such as brown coal and subbituminous coal contains a large amount of moisture, has a low calorific value, and has a strong tendency toward spontaneous ignition. These shortcomings prevent low grade coal from being transported over a long distance for expanded use. A common practice to reduce moisture content is to heat coal at 80°–150° C. This drying method, however, has a disadvantage that the dried coal readily absorbs moisture again and is more liable to spontaneous ignition. To overcome this disadvantage, there have been proposed several processes.

U.S. Pat. Nos. 1,632,829 and 1,679,078 disclose the Fleissner process. According to this process, low grade coal is dried by using saturated steam under a high pressure. It has been in commercial use for the improvement of brown coal in Europe since 1927.

U.S. Pat. Nos. 4,052,168, 4,127,391, and 4,129,420 disclose the Koppelman Process. According to this process, brown coal is heated in an autoclave for 15–60 minutes at a high temperature (1000°–1250° F.) under a high pressure (1000–3000 psi). U.S. Pat. No. 4,126,519 discloses the Murray Process. According to this process, coal in the slurry form is heated at 950° F. under a pressure of 1495 psi.

Other related processes are found in U.S. Pat. Nos. 2,579,397, 3,001,916, 3,061,524, 3,112,255, 3,133,010, 3,441,394, 3,463,623, 4,104,129, 4,158,697, 4,162,959, 4,274,941, 4,278,445, 4,331,529, 4,359,451, 4,366,044, 4,383,912, 4,291,539, 3,977,947, and 3,520,795.

The disadvantage of these conventional processes is that (1) an extremely high pressure (1000–3000 psi) is required, (2) a high temperature (1000°–1200° F.) is required, and (3) a long residence time (15–60 minutes) is required. All this leads to a high treatment cost.

The prior arts similar to the process of the present invention include a process for producing improved coal by heating and cooling low grade coal in a fluidized bed. (See U.S. Pat. Nos. 4,501,551, 4,495,710, 4,401,436, 4,396,394, 4,467,531, 4,421,520, 4,420,207, and 4,402,706.) This process is essentially different from that of the present invention as described in the following.

(1) The final heating temperature is 130°–250° F. (54°–121° C.), which is much lower than the heating temperature in the process of the invention. As the result, the feed coal is dried to such an extent that the moisture content is 5–10% and the dried coal absorbs moisture again and still has a tendency toward spontaneous ignition. In other words, this process does not change the physical and chemical properties of coal, unlike the process of the invention in which coal is heated above 200° C.

(2) To make the dried coal less liable to spontaneous ignition, said process is designed to treat the dried coal, after cooling, with an inert fluid such as oil. This additional step is not of practical use, because it requires a large amount of inert fluid and it is almost impossible to spread the inert fluid in the form of thin uniform film on the surface of coal lumps. In addition, the inert fluid oozes out during the transportation and storage of coal, which aggravates the handling properties of coal.

(3) In the cooling step, the dried coal is cooled to 100° F. (38° C.) or below by spraying water in the fluidized bed. However, in said process, no consideration is given to the characteristic properties of coal such as heat of wetting and limit of moisture by wetting, unlike the process of the present invention. It is easily conjectured that upon cooling by water spraying, the dried coal absorbs moisture again to almost the same level as that of feed coal, because feed coal is simply dried at a comparatively low temperature without any treatment to avoid moisture resorption. This conjecture has been experimentally proved by the present inventors.

The other related process is disclosed in U.S. Pat. No. 4,325,544. It is intended to produce a heat source (400°–600° F.) by partial combustion of coal in a fluidized bed. Therefore, it is based on a technical idea different from that of the present invention. Incidentally, it is almost impracticable because of difficulties in temperature control (extent of drying of coal) and uniform heating of fluidized bed.

On the other hand, the present inventors proposed in Japanese Patent Application No. 68865/1979 a process for improving low grade coal by rapid heating to a comparatively high temperature and subsequent rapid cooling.

This process is designed for operation on a comparatively small scale and hence different from the process of the invention in the object it treats and the condition under which it is run. The following were learned from experience in running this process.

(1) Where a fluidized bed is used as a rapid heating furnace for a large amount of coal, it is necessary to limit the residence time of coal in the fluidized bed.

(2) Since raw coal greatly varies in particle diameter and hence in heat transfer, it is necessary to limit the heating time, particularly in the case of coal smaller than 2 inches in particle diameter.

(3) It is necessary to establish a condition for safety operation, so as to minimize the amount of volatile gases evolved during heat treatment of coal at a high temperature and the amount of carbon monoxide gas evolved by the reaction of coal with oxygen.

(4) Coal improvement by heating takes place differently from one grade of coal to another. For example, the coal mentioned in Japanese Patent Application No. 68865/1979 contains a large amount of tar and oozes out tar when heated. By contrast, in the case of low-sulfur subbituminous coal for power generation which comes from open pit mining in the Northwestern part of the U.S., the phenol groups and carboxyl groups in the coal decompose upon heating, rendering the coal hydrophobic, as mentioned in Japanese Patent Application No. 189214/1985. The decomposition takes place at a low temperature; therefore, it is possible to lower the heat-treatment temperature in the process of the invention.

OBJECT AND SUMMARY OF THE INVENTION

It is an object of the present invention to provide a process for the heat treatment of coal, said process being suitable for the improvement of low grade coal with a low tar content. The process was developed to meet the following conditions and to eliminate the drawbacks of the conventional technologies.

(1) The treated coal has a low moisture content and a high calorific value, and is less liable to moisture resorption and spontaneous ignition during storage.

(2) The heat treatment can be applied to a large amount of coal for power generation economically at a low cost without need for superhigh pressure and temperature and long residence time.

(3) The heat treatment permits rapid and uniform heating even in the case of raw coal containing large lumps.

(4) The heat treatment evolves only a small amount of volatile gases and carbon monoxide gas as a reaction product of coal and oxygen.

Accordingly, the present invention provides a process for the heat treatment of coal as mentioned in the following.

(1) A process for the heat treatment of coal which comprises heating and drying low grade coal such as subbituminous coal and brown coal containing less than 80% of carbon and more than 33% of volatile matter (dry mineral matter-free basis) and having a high moisture content and a particle diameter smaller than 2 inches, with a high-temperature gas containing less than 5% of oxygen in a fluidized bed for 2–10 minutes until the coal temperature reaches 180°–400° C., and subsequently cooling the coal by spraying water in a fluidized bed for 2–10 minutes until the coal temperature decreases to 60° C. or below at which the coal holds the maximum moisture given by wetting.

(2) A process for the heat treatment of coal which comprises heating and drying low grade coal such as subbituminous coal and brown coal containing less than 80% of carbon and more than 33% of volatile matter (dry mineral matter-free basis) and having a high moisture content and a particle diameter smaller than 2 inches, with a high-temperature gas containing less than 5% of oxygen in a fluidized bed for 2–10 minutes until the coal temperature reaches 180°–400° C., and subsequently rapidly cooling the heated coal first by spraying water in a fluidized bed for 2–10 minutes and also using a gas of high steam content until the coal temperature decreases to about 120° C. and secondly by spraying water until the coal temperature decreases to 60° C. or below at which the coal holds the maximum moisture given by wetting.

(3) A process for the heat treatment of coal which comprises heating and drying low grade coal such as subbituminous coal and brown coal containing less than 80% of carbon and more than 33% of volatile matter (dry mineral matter-free basis) and having a high moisture content and a particle diameter smaller than 2 inches, first with a high-temperature gas until the coal temperature reaches 80°–150° C. and the moisture decreases below the inherent moisture and secondly with a high-temperature gas containing less than 5% of oxygen in a fluidized bed for 2–10 minutes until the coal temperature reaches 180°–400° C., and subsequently cooling the coal by spraying water in a fluidized bed for 2–10 minutes until the coal temperature decreases to 60° C. or below at which the coal holds the maximum moisture given by wetting.

(4) A process for the heat treatment of coal which comprises heating and drying low grade coal such as subbituminous coal and brown coal containing less than 80% of carbon and more than 33% of volatile matter (dry mineral matter-free basis) and having a high moisture content and a particle diameter smaller than 2 inches, first with a high-temperature gas until the coal temperature reaches 80°–150° C. and the moisture decreases below the inherent moisture and secondly with a high-temperature gas containing less than 5% of oxygen in a fluidized bed for 2–10 minutes until the coal temperature reaches 180°–400° C., and subsequently rapidly cooling the heated coal first by spraying water in a fluidized bed for 2–10 minutes and also using a gas of high steam content until the coal temperature decreases to about 120° C. and secondly by spraying water until the coal temperature decreases to 60° C. or below at which the coal holds the maximum moisture given by wetting.

According to the process of the invention, the above-mentioned requirement (2) is satisfied by using a large-capacity heating and cooling apparatus of fluidized bed type which is capable of continuous operation. The fluidized bed permits good heat transfer between coal and gas and consequently permits the heat treatment of large lumps of coal in a short residence time. The heating temperature is low and the residence time of coal in the fluidized bed is limited so that the evolution of volatile gas is suppressed. In addition, the high-temperature heating gas that comes into contact with coal is limited in oxygen content so that the evolution of carbon monoxide gas is suppressed. The heated coal is cooled below the safety temperature by spraying water directly to the coal in the cooling fluidized bed. In this way, the coal is previously wetted to the wetting limit in order to prevent the coal from generating heat of wetting during storage.

These and other objects and advantages of the invention may be readily ascertained by referring to the following description and appended drawings.

DETAILED DESCRIPTION OF PREFERRED EMBODIMENTS

Figure 2:
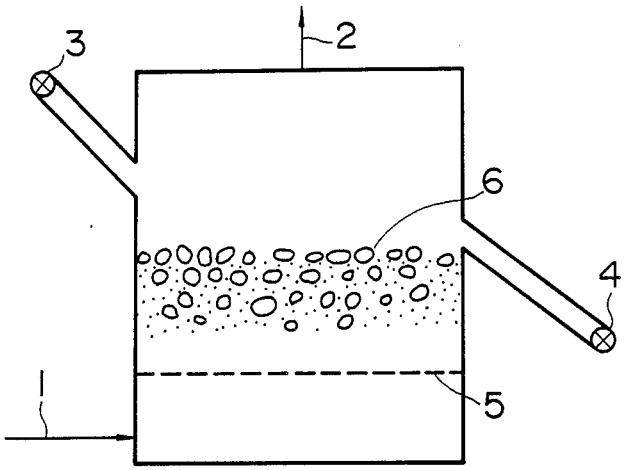
FIG. 2 is a schematic representation of the heating furnace of fluidized bed type used in an example of the invention.
Figure 3:
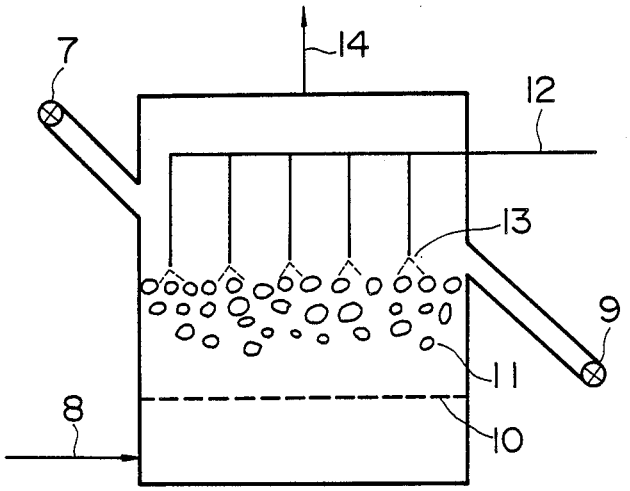
FIG. 3 is a schematic representation of the cooling apparatus of fluidized bed type used in an example of the invention.

FIG. 2 is a schematic representation of the heating furnace of fluidized bed type. Coal is fed into the fluidized bed 6 through the feeder 3. The high-temperature gas for fluidization is fed into the fluidized bed through the perforated plate 5 from the high-temperature gas inlet 1. In the fluidized bed 6, the coal comes into contact with the high-temperature gas for heat exchange while being fluidized. The gas is discharged from the system through the gas outlet 2. The heated coal is discharged from the system through the discharger 4. FIG. 3 is a schematic representation of the cooling apparatus of fluidized bed type used in the process of the invention. Coal is fed into the cooling fluidized bed 11 through the feeder 7. The cooling gas is fed into the cooling fluidized bed through the perforated plate 10 from the cooling gas inlet 8. The coal comes into contact with the cooling gas for heat exchange while being fluidized. In the cooling fluidized bed 11, cooling water supplied from the cooling water feeder 12 is sprayed through the nozzles 13. Thus the heat of coal is removed by the latent heat of vaporization. The gas which has undergone heat exchange is discharged from the system through the gas discharger 14. The cooled coal is discharged through the discharger 9.

Since the fluidized bed permits efficient contact between coal and gas, heat transfer takes place rapidly and is completed usually within a residence time of 2–10 minutes. In addition, the coal is heated uniformly on account of thorough stirring by fluidization. The fluidized bed can be operated continuously by feeding and discharging coal continuously. Therefore, it can treat a large amount of coal.

Figure 4:
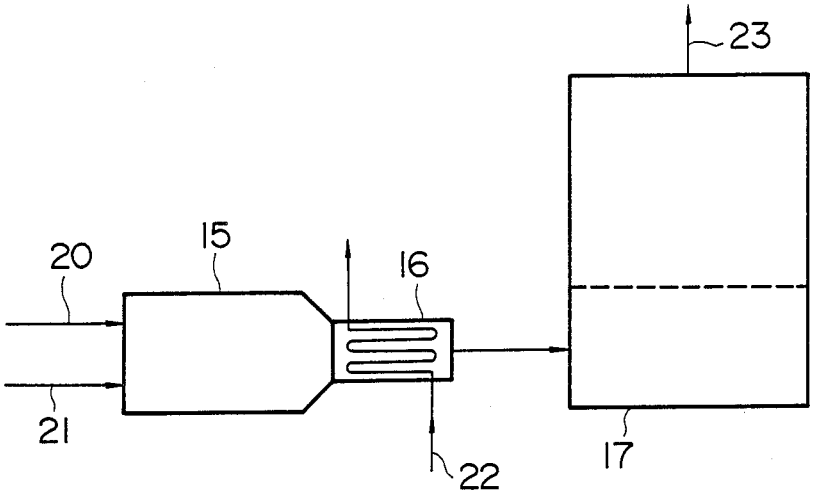
FIGS. 4 and 5 are schematic representations of the furnace to generate a heated gas of low oxygen content used in the invention.
Figure 5:
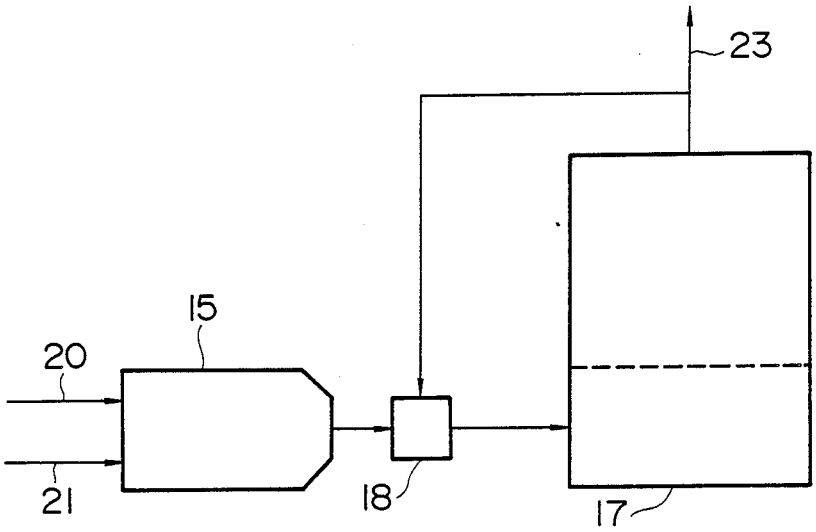

FIGS. 4 and 5 are schematic representations of the furnace to generate a heated gas of low oxygen content. In FIG. 4, the fuel 20 and air 21 are fed into the hot-air generating furnace 15, in which the fuel is burned to give an exhaust gas containing less than 5% of oxygen. Since this exhaust gas is at a high temperature above 1000° C., it is cooled to about 500° C. by means of the indirect heat exchanger 16 through which the cooling water 22 passes. The thus obtained heating gas is fed to the heating fluidized bed 17. If the coal is to be heated to about 300° C. in the heating fluidized bed 17, the exhaust gas at about 300° C. is supplied from the indirect heat exchanger 16. FIG. 5 shows the apparatus of recycling type. The high-temperature gas generated in the furnace 15 is mixed in the mixer 18 with a portion of the exhaust gas 23 at about 300° C. discharged from the heating fluidized bed 17. Thus there is obtained the heating gas at about 500° C. which contains less than 5% of oxygen. The unnecessary excess gas is discharged from the system. This recycling system is advantageous over the indirect heat exchange system in that the fuel consumption is low and the expensive indirect heat exchanger is not required.

Figure 6:
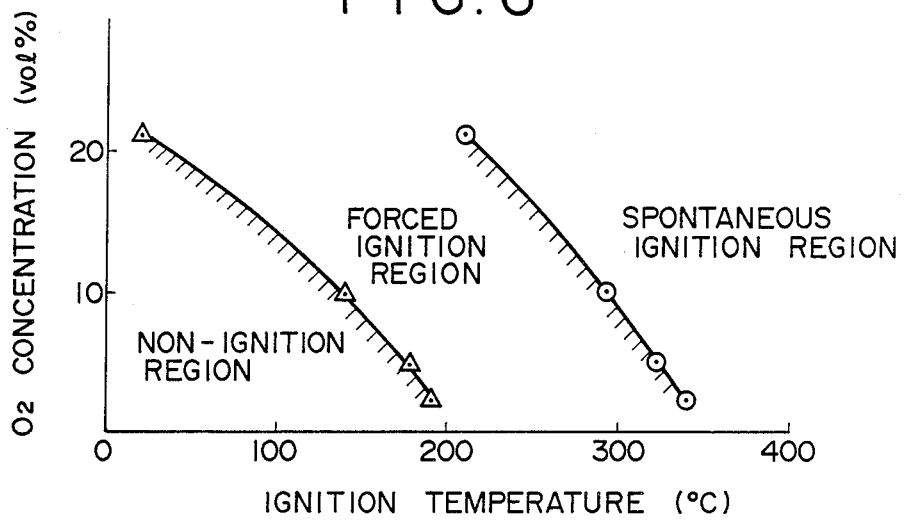
FIG. 6 is a graph showing the relationship between the oxygen concentration and the ignition temperature.

FIG. 6 is a graph showing the relationship between the oxygen concentration and the ignition temperature. The ignition temperature rises as the oxygen concentration decreases. The spontaneous ignition temperature is about 320° C. when the oxygen concentration is 5%. The ignition of coal, which evolves carbon monoxide gas undesirable for plant safety, is avoided by keeping the oxygen concentration below 5%. "Forced ignition" in FIG. 6 means ignition induced by sparks or by contact with a high-temperature object. It is also treated as the spontaneous ignition in the present invention.

Figure 7:
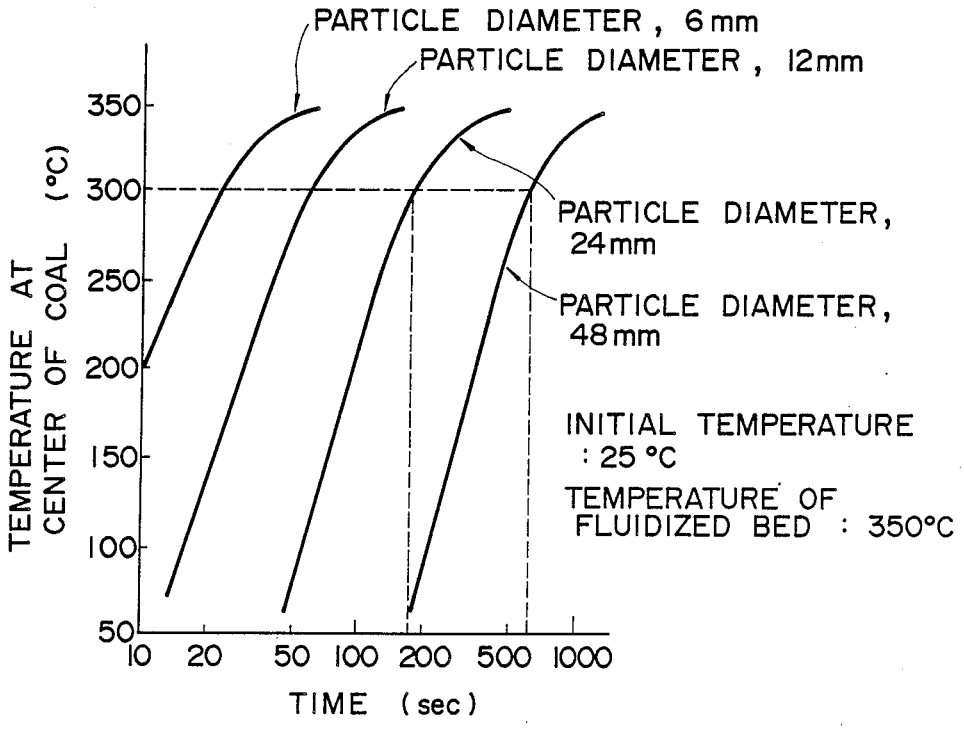
FIG. 7 is a graph showing the change with time of the temperature at the center of each coal particle in the fluidized bed.
Figure 8:
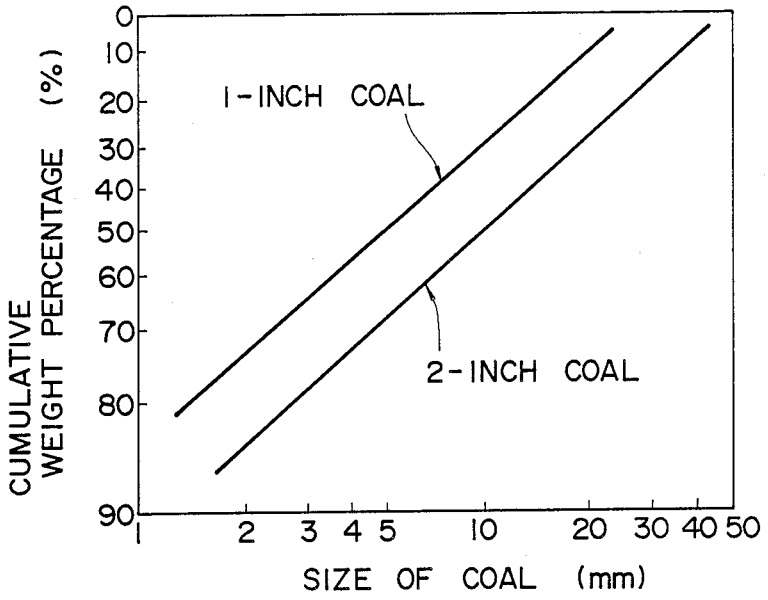
FIG. 8 is a graph showing the size distribution of coal for heat treatment on an industrial scale.

FIG. 7 is a graph showing the change with time of the temperature at the center of each coal lump in the fluidized bed. The coal for heat treatment on an industrial scale contains lumps of various sizes ranging from about 1 inch (24 mm) to about 2 inches (48 mm) as shown in FIG. 8. For all the coal lumps to be heated thoroughly, a certain time (residence time in the fluidized bed) is required as shown in FIG. 7. For example, 2-inch coal will require about 600 seconds (10 minutes) of residence time and 1-inch coal will require about 180 seconds (3 minutes) of residence time, assuming that the coal has an initial temperature of 25° C. and is heated to 300° C. in the fluidized bed at 350° C. Thus the residence time in the fluidized bed varies depending on the size of coal to be treated.

Figure 9:
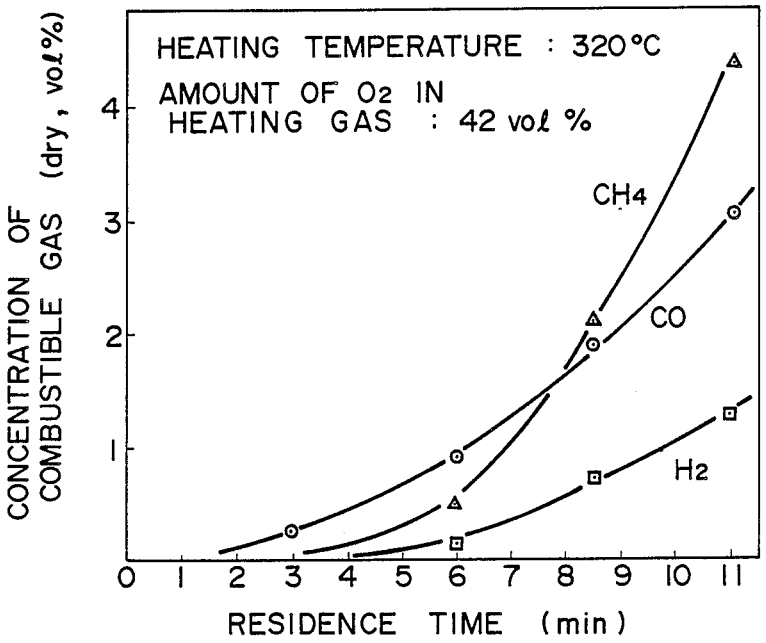
FIG. 9 is a graph showing the relationship between the residence time and the concentration of combustible gas in the exhaust gas.

The exhaust gas produced under such temperature conditions was examined for concentration of combustible gas. The results are shown in FIG. 9. The combustible gases include methane ($CH_4$) and hydrogen ($H_2$) originating from the volatile matter in coal and carbon monoxide formed by the reaction of coal with oxygen in the heating gas. The amount of the combustible gases increases as the residence time increases. With a residence time of 10 minutes, the concentrations of $CH_4$, CO, and $H_2$ are 3.5 vol%, 2.5 vol%, and 1.1 vol%, respectively. At these concentrations, there is a possibility of explosion. Therefore, the residence time should be limited to about 10 minutes.

According to the invention, the heating temperature is 180°–400° C. for reasons mentioned below. In the present inventors' previous invention disclosed in Japanese Patent Application No. 68865/1979, the heating temperature was 300°–500° C. because the coal used in that invention contained a large amount of tar and heating at a high temperature was necessary to cause the tar to ooze out from the coal. By contrast, the subbituminous coal coming from the Northwestern part of the U.S. which is treated by the process of the invention contains such a small amount of tar that tar oozes out only a little when the coal is heated up to 300°–500° C. Instead, upon heating at such a high temperature, hydrophilic groups such as phenol groups and carboxyl groups in the coal decompose, liberating oxygen, to form hydrophobic groups such as alkyl groups, as described in Japanese Patent Application No. 189214/1985. This decomposition starts at about 180° C. and completes at about 400° C. The resulting chemical change lowers the ability of coal to absorb moisture again. To avoid this unfavorable chemical change of coal, the heating temperature should be 180°–400° C.

Figure 10:
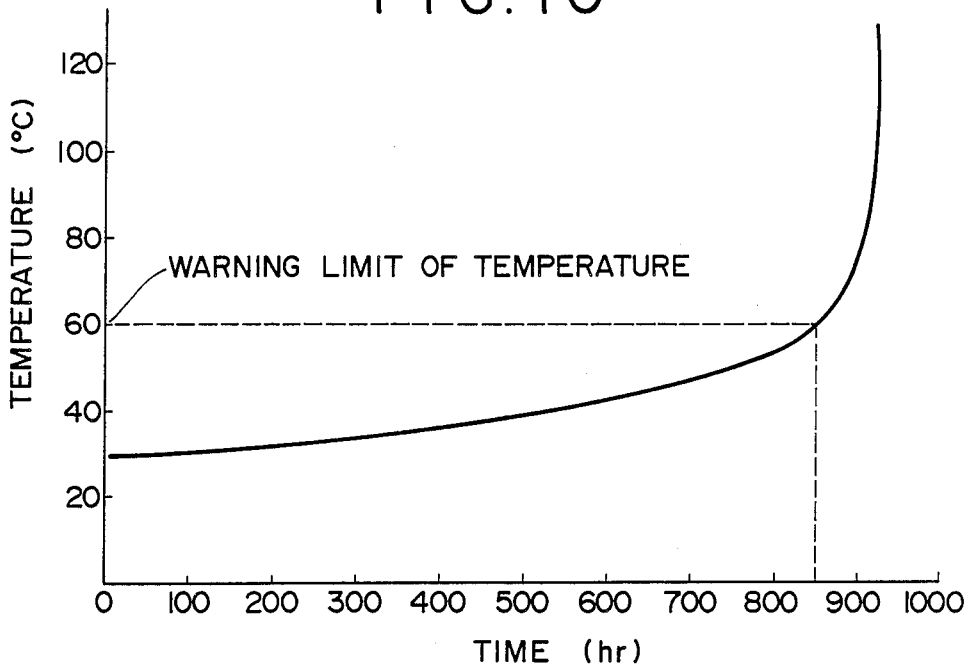
FIG. 10 is a graph showing the relationship between the coal storage time and the coal storage temperature.

According to the invention, the heated coal is cooled to 60° C. or below for the reasons mentioned in the following. In the conventional practice, the cooling temperature was 250° C. or below; but it has become necessary to greatly lower it in order to avoid spontaneous ignition during storage in actual plants. With a coal temperature higher than 60° C., there are great possibilities of spontaneous ignition, as is apparent from FIG. 10 showing the relationship between the coal storage time and the coal storage temperature. Therefore, 60° C. is regarded as the warning limit of temperature in coal storage. Thus the cooling temperature should be lower than 60° C.

Figure 11:
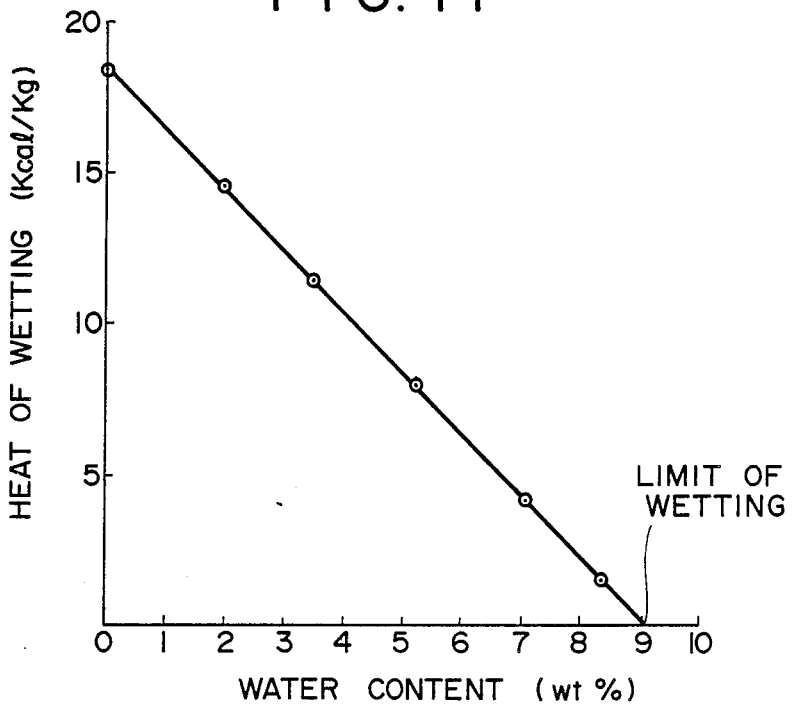
FIG. 11 is a graph showing the relationship between the moisture of heat-treated coal and the heat of wetting of heat-treated coal.

As for the moisture content of treated coal, it was found in the recent studies that dried coal absorbs moisture and swells during storage, generating heat of wetting. The result of measurements is shown in FIG. 11. It is noted that dried coal generates heat in an amount of 18.4 kcal/kg when it absorbs moisture. The heat thus evolved induces the spontaneous ignition during storage. It was found that spontaneous ignition can be avoided if the dried coal is previously wetted until the moisture content reaches about 9% which is the maximum attained by wetting.

EXAMPLE

Figure 1:
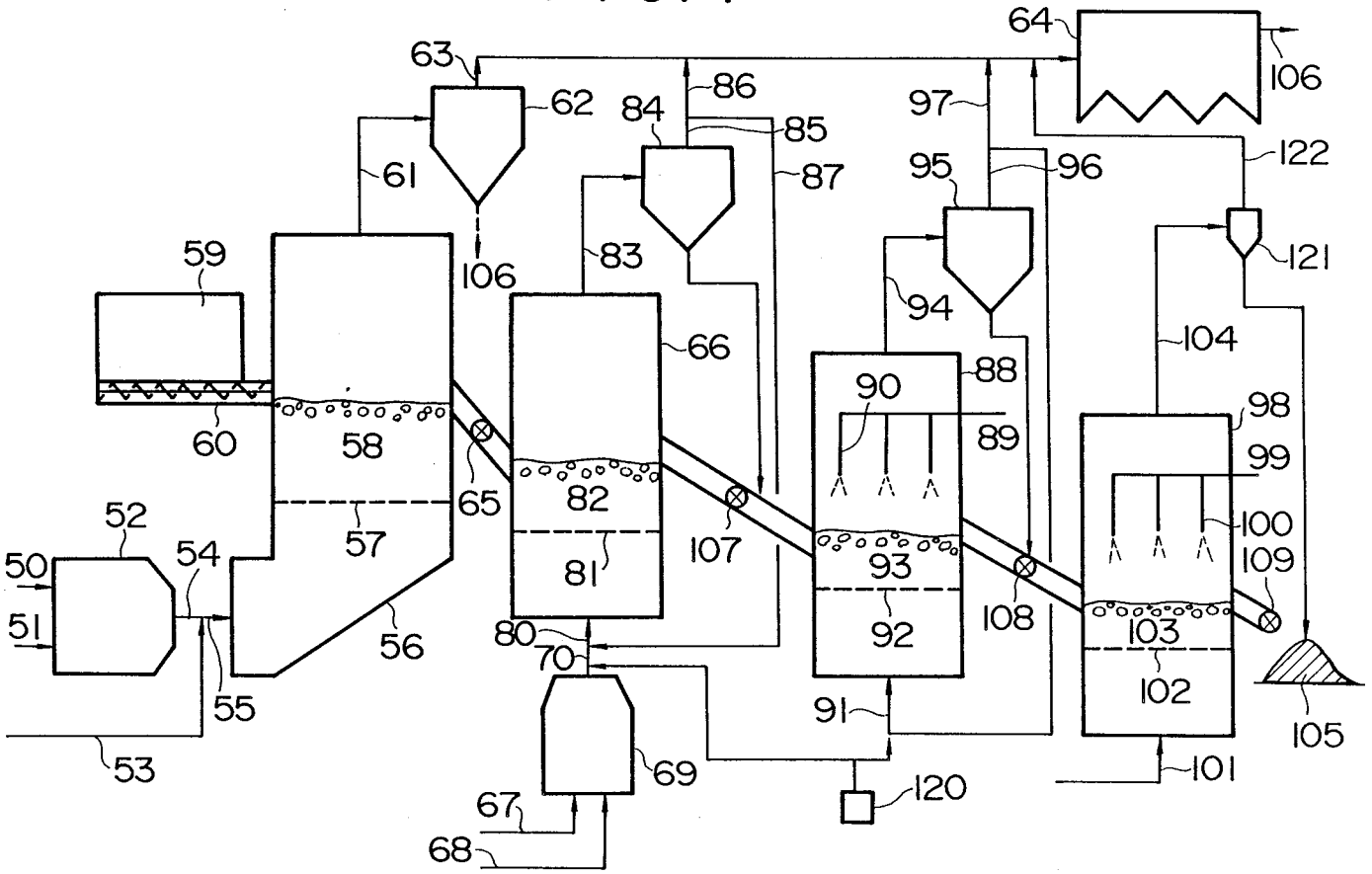
FIG. 1 is a schematic representation of the apparatus used in an example of the invention.

The heat treatment of coal according to the invention is practiced by using the apparatus as schematically shown in FIG. 1. In FIG. 1, there are shown the fuel 50 for drying, the air 51 for combustion, and the hot-air generating furnace 52. The hot air 54 (higher than 1000° C.) generated by the furnace 52 is mixed with air 53 at normal temperature to give the heating gas 55 (about 500° C.) for drying. The heating gas 55 enters the drying furnace 56. The feed coal 59 having a particle size smaller than 1 inch and containing 30% of moisture is continuously fed into the drying furnace 56 by means of the screw feeder 60. In the drying furnace 56, the fluidized bed 58 is formed on the perforated plate 57. The temperature of the fluidized bed 58 is about 100° C. The dried coal goes to the next step through the discharger 65. The coal leaving the fluidized bed 58 is at about 100° C. and contains 10–15% of moisture, with the surface moisture removed. The exhaust gas 61 from the drying furnace 56 is introduced into the cyclone 62 for the removal of fine dust. The exhaust gas 63 from the cyclone 62 is introduced into the dust collector 64. The dry fine coal 106 is used as the fuel 50 and 67 for the hot-air generating furnaces.

The coal may be heated to 180°–400° C. in the furnace 56 for heat treatment in one step; or alternatively, the coal may be heated in two steps as in this example. In the latter case, the heat treatment is performed in two steps, i.e., drying and heating. The one-step heating is economical from the standpoint of facilities; but the two-step heating is advantageous in that the crushing of coal is minimized and the yield of granular and lumpy coal of high commercial value increases. The crushing of coal in the heating step is due mainly to heat shock induced by rapid heating.

The drying furnace is not limited to that of fluidized bed type; but drying furnaces of other types such as rotary kiln and grate kiln may be used.

In the subsequent rapid heating furnace 66, the coal is rapidly heated from 100° C. to 320° C. The residence time in this heating furnace should be 3–5 minutes for 1-inch coal and 5–10 minutes for 2-inch coal. With a residence time longer than these limits, the concentration of combustible gases in the recycling gas 87 increases to endanger the operation. The hot air generating furnace 69 is supplied with the fuel 67 and combustion air 68. The hot air generating furnace 69 is usually run at an air-fuel ratio of 1.05 so as to keep low the oxygen concentration in the combustion product. The hot air generating furnace 69 generates the high-temperature gas 70 (higher than 1000° C.) containing less than 5% of oxygen. The high-temperature gas 70 is mixed with a portion of the exhaust gas 87 (320°–350° C.) discharged from the rapid heating furnace 66, so that the temperature is adjusted to 500° C. and the oxygen content is adjusted to 5% or below. The thus prepared heating gas 80 is introduced into the rapid heating furnace 66. The temperature of the heating gas is set up at 500° C. in consideration of the heat resistance of the grate 81 and the possible ignition of coal. The coal is rapidly heated to 320° C. to become bone dry in the fluid zone 82 of the rapid heating furnace 66. The exhaust gas 83 (320°–350° C.) discharged from the rapid heating furnace 66 enters the cyclone 84 for the removal of fine dust. A portion of the exhaust gas 87 is recycle and the unnecessary excess gas 86 is introduced into the dust collector 64. The fine coal collected by the cyclone 84 is mixed with the heat-treated coal 107, which is fed to the cooling step. Incidentally, the hot-air generating furnaces 52 and 69 are installed separately in this example; but a single furnace may suffice.

The heat-treated coal is rapidly cooled by the quencher 88. In the quencher 88, the coal is fluidized by the steam evolved by the vaporization of the cooling water fed from the cooling water inlet 89. The cooling water is sprayed through a multiplicity of nozzles 90 installed in the quencher 88. The cooling water takes the sensible heat of the heated coal to become steam. The fluidized bed 93 in the quencher 88 is set up at 120° C. in consideration of the condensation of steam in the cyclone 95 and recycling line 91. The residence time in the fluidized bed 93 is 5–10 minutes for 2-inch coal and 3–5 minutes for 1-inch coal in consideration of the cooling rate of coal particles. The nozzles 90 are arranged above the layer of coal particles being fluidized so that the cooling water is uniformly sprayed onto the surface of coal particles. The exhaust gas 94 (120° C.) is partly recycled through the line 91 after dust removal by the cyclone 95. The unnecessary excess gas 97 is discharged from the system through the dust collector 64. In the initial stage of operation of the quencher 88, air may be used as the recycling gas because the temperature of the heated coal 107 discharged from the rapid heating furnace 66 is still low. When the coal temperature exceeds 300° C., the recycling gas of air induces the ignition of coal. To avoid this, the oxygen concentration in the recycling gas should be kept lower than 5% by feeding an inert gas from the inert gas generator 120 or spraying a small amount of water from the nozzles 90. Incidentally, the inert gas generator 120 is also used to ensure the safety when the system is shut down.

The cooling may be accomplished in one step or two steps. In the former case, the coal is rapidly cooled to 60° C., and in the latter case, the coal is cooled to 120° C. by steam and subsequently cooled to 60° C., as in this example. The former is economical from the standpoint of facilities. However, the two-step cooling is required if the temperature of the heat-treated coal exceeds 300° C., in which case the fluidization should be performed with an inert gas such as steam because coal ignites when the oxygen concentration in the gas is higher than 5%.

After cooling to 120° C. by the quencher 88, the coal is sent to the secondary cooler 98 through the discharger 108. Since there is no possibility of ignition, the coal is fluidized by air 101 in the secondary cooler 98. The cooling water supplied through the secondary cooling water inlet 99 is uniformly sprayed onto the coal through the spray nozzles 100. The amount of the cooling water is controlled such that the coal moisture reaches the limit of wetting. The exhaust gas 104 is discharged through the cyclone 121 for dust removal. The fine coal collected by the cyclone 121 is mixed with the product 105. The exhaust gases 63, 86, 97, and 122 are released into the atmosphere after dust removal by the dust collector 64.

Incidentally, the secondary cooler is not necessarily of fluidized bed type; but it may be of any any type such as rotary kiln, grate kiln and coller.

Table 1 shows the characteristic properties of the feed coal used in the example.

TABLE 1

| Item | Feed coal | Treated coal |
|---|---|---|
| Total moisture (wt %) | 31.5 | 9.2 |
| Equilibrium moisture (wt %) | 21.3 | 11.0 |
| Ash (wt %) | 6.3 | 8.5 |
| Volatile matter (wt %) | 31.0 | 40.4 |
| Fixed carbon (wt %) | 31.2 | 42.0 |
| Calorific value (kcal/kg) | 4343 | 5947 |
| C | 68.7 | 68.9 |
| H | 4.7 | 4.6 |
| N | 0.9 | 1.0 |
| S (combustible) | 0.1 | 0.1 |
| O | 17.1 | 16.6 |
| Ash | 8.5 | 8.5 |

It is noted from Table 1 that as the result of heat treatment, the moisture reduced from 31.5 wt% to 9.2 wt%, the calorific value increased from 4343 kcal/kg to 5947 kcal/kg, and the equilibrium moisture decreased from 21.3 wt% to 11.0 wt%. The moisture content of the treated coal measured after storage for about 2 weeks at 15° C. and 55% RH was 9.0 wt%, which is almost equal to that (9.2 wt%) measured immediately after heat treatment.

Table 2 shows the yield of treated coal on the bone dry basis.

TABLE 2

| | |
|---|---|
| Feed coal (on bone dry basis) | 7200 tons |
| Treated coal (on bone dry basis) | 6480 tons |
| Dry fine coal | 648 tons |

After operation for 10 days, 7200 tons of feed coal was treated to give 6480 tons of treated coal and 648 tons of dry fine coal (finer than 1 mm). The fine coal was consumed as the fuel for the plant. The loss in the form of volatile matter and dust is about 1% of the feed coal.

The heat-treated coal discharged from the secondary cooler was cooled by about 15° C. on the conveyor. The coal temperature was 39° C. in the initial stage of storage, and it did not exceed 60° C. during storage for about 2 months. The additional advantage of the heat-treated coal is that it gives off very little dust during transportation by a cart.

According to the process of the invention, a large amount of coal is rapidly heated to 180°–400° C. by using a fluidized bed and subsequently cooled to 60° C. or below by water spraying in a fluidized bed. Even large lumps of coal can be uniformly heated and cooled by limiting the residence time in both fluidized beds to 2–10 minutes. The evolution of combustible gas is reduced below the explosion limits. The heat-treated coal is cooled to 60° C. or blow and wetted to the wetting limit so that the heat-treated coal is protected from spontaneous ignition during storage. Thus the process of the invention can change low-grade coal of high moisture content into improved coal of low moisture content having a high calorific value and a minimum of liability to moisture resorption.

What is claimed is:

1. A process for the heat treatment of coal which comprises heating and drying low grade coal containing less than 80% by weight of carbon and more than 33% by weight of volatile matter on a dry mineral matter-free basis and having a high moisture content and a particle diameter smaller than 2 inches, with a high-temperature gas containing less than 5% of oxygen in a fluidized bed for 2–10 minutes until the coal temperature reaches 180°–400° C., and subsequently cooling the coal by spraying it with water in a fluidized bed for 2–10 minutes until the coal temperature decreases to 60° C. or below at which time the resultant coal holds the maximum moisture given by wetting.

2. A process for the heat treatment of coal which comprises heating and drying low grade coal containing less than 80% by weight of carbon and more than 33% by weight of volatile matter on a dry mineral matter-free basis and having a high moisture content and a particle diameter smaller than 2 inches, with a high-temperature gas containing less than 5% of oxygen in a fluidized bed for 2–10 minutes until the coal temperature reaches 180°–400° C., and subsequently rapidly cooling the heated coal first by spraying it with water in a fluidized bed for 2–10 minutes and also contacting it with a gas of high steam content until the coal temperature decreases to about 120° C. and secondly by spraying it with water until the coal temperature decreases to 60° C. or below at which time the resultant coal holds the maximum moisture given by wetting.

3. A process for the heat treatment of coal which comprises heating and drying low grade coal containing less than 80% by weight of carbon and more than 33% by weight of volatile matter on a dry mineral matter-free basis and having a high moisture content and a particle diameter smaller than 2 inches, first with a high-temperature gas until the coal temperature reaches 80°–150° C. and the moisture decreases below the inherent moisture and secondly with a high-temperature gas containing less than 5% of oxygen in a fluidized bed for 2–10 minutes until the coal temperature reaches 180°–400° C., and subsequently cooling the coal by spraying it with water in a fluidized bed for 2–10 minutes until the coal temperature decreases to 60° C. or below at which time the resultant coal holds the maximum moisture given by wetting.

4. A process for the heat treatment of coal which comprises heating and drying low grade coal containing less than 80% by weight of carbon and more than 33% by weight of volatile matter on a dry mineral matter-free basis and having a high moisture content and a particle diameter smaller than 2 inches, first with a high-temperature gas until the coal temperature reaches 80°–150° C. and the moisture decreases below the inherent moisture and secondly with a high-temperature gas containing less than 5% of oxygen in a fluidized bed for 2–10 minutes until the coal temperature reaches 180°–400° C., and subsequently rapidly cooling the heated coal first by spraying it with water in a fluidized bed for 2–10 minutes and also using a gas of high steam content until the coal temperature decreases to about 120° C. and secondly by spraying it with water until the coal temperature decreases to 60° C. or below at which time the resultant coal holds the maximum moisture given by wetting.

* * * * *